US006438887B1

(12) United States Patent
Martin

(10) Patent No.: US 6,438,887 B1
(45) Date of Patent: Aug. 27, 2002

(54) DISCHARGEABLE HAND WEAPONS HAVING REDUCED CRIMINAL USEFULNESS

(76) Inventor: John Mikel Martin, 15 Charing Cross, Brownsville, TX (US) 78521

( * ) Notice: Subject to any disclaimer, the term of this patent is extended or adjusted under 35 U.S.C. 154(b) by 0 days.

(21) Appl. No.: 09/845,123

(22) Filed: Apr. 30, 2001

(51) Int. Cl.[7] ..... F41A 17/00
(52) U.S. Cl. ..... 42/70.11
(58) Field of Search ..... 42/70.11, 70.06, 42/70.01, 70.09, 96, 66

(56) References Cited

U.S. PATENT DOCUMENTS 5,168,114 A * 12/1992 Enget ..... 42/70.01
5,537,771 A * 7/1996 Martin ..... 42/70.01
5,564,211 A * 10/1996 Mossberg et al. ..... 42/70.11
5,675,925 A * 10/1997 Wurger ..... 42/70.11
5,828,301 A * 10/1998 Sanchez ..... 340/539
5,953,844 A * 9/1999 Harling et al. ..... 42/70.06
6,223,461 B1 * 5/2001 Mardirossian ..... 42/70.11
6,281,792 B1 * 8/2001 Lerg et al. ..... 340/540
6,314,671 B1 * 11/2001 Gering ..... 42/70.11

* cited by examiner

*Primary Examiner*—Charles T. Jordan
*Assistant Examiner*—Danielle Rosenthal

(57) ABSTRACT

Methods and apparatuses for reducing the criminal usefulness of a dischargeable hand weapon by transmitting radio signals between the location of the weapon and at least three different known locations and by using a device for reckoning the location of the weapon based on the travel times of the signals (triangulation), a memory storage device for storing information of at least one area where discharging of the weapon is allowed, a comparing device for deducing if the weapon is in an area where discharging is allowed, and a device for preventing its discharging if it is not within such an area.

10 Claims, 1 Drawing Sheet

DISCHARGEABLE HAND WEAPONS HAVING REDUCED CRIMINAL USEFULNESS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

This invention relates to dischargeable hand weapons and in particular to methods and apparatuses for reducing the criminal usefulness of such weapons.

2. Description of Related Art

Colts has reportedly produced a prototype of a handgun that can be fired only by a person authorized to fire it.

U.S. Pat. Nos. 5,423,142, 5,192,818, and 5,068,989 disclose several methods and apparatuses for reducing the criminal usefulness of dischargeable hand weapons.

U.S. Pat. No. 4,682,435 discloses a safety system for selectively disabling a firearm.

U.S. Pat. No. 4,672,763 discloses a device for preventing the unauthorized firing of a weapon.

U.S. Pat. No. 4,563,827 discloses a safety system for disabling a firearm.

U.S. Pat. No. 4,488,370 discloses a weapon system and method for controlling the operation of a weapon to prevent it from being accidentally operated or operated by an unauthorized person.

U.S. Pat. No. 4,154,014 discloses an apparatus for preventing unauthorized activation of a touch-operable device.

U.S. Pat. No. 4,003,152 discloses a safety system for firearms.

U.S. Pat. No. 3,400,393 discloses a safety mechanism that prevents a weapon form being discharged while aimed toward a source of electromagnetic waves.

BRIEF SUMMARY OF THE INVENTION

Dischargeable hand weapons are popular for defense of persons and for hunting. Reducing the criminal usefulness of those weapons would save many lives and reduce injuries and poaching. There are several ways of accomplishing this. One way is by limiting the areas of usefulness. Accordingly, the main object of this invention is to provide methods and means for preventing the discharging of a hand weapon in locations where discharging of the weapon is not allowed.

The location of any object can be determined from information of its distance from at least three known locations (triangulation). Because all radio waves travel at the speed of light, one can also use at least three radio signals and time information to calculate an object's location. This method will work either by sending radio signals from three different locations to one radio receiver or by sending the radio signals from the location in question to receivers at three different locations. Both GPS (global positioning system) and cellular telephone technologies that can determine the locations of 911 calls use radio signals to determine locations. Because of altitude and other considerations, more precise locations can be obtained by using more than three radio signals or averaging several location determinations. Memory storage technology can provide a means for storing the information of where the discharging of a hand weapon is allowed. It is therefore an object of this invention to combine that technology with the radio wave location determining technology to determine if a dischargeable hand weapon is at a location where its discharging is allowed and to prevent it from discharging if it is not. For example, a handgun that is kept in a certain house for defense and is used for hunting in a certain area where hunting is allowed, will thereby be prevented from firing in all other areas. Thus, this invention will reduce the criminal usefulness of a hand weapon by making it useless for crimes outside of its allowed discharging areas while allowing it to be useful for defense in homes and businesses and for hunting.

BRIEF DESCRIPTION OF THE DRAWINGS

The two drawings are not to scale and some obviously necessary parts are omitted (e.g., wires), or some parts are modified in shape in order to allow for clearer illustration of other parts.

DETAILED DESCRIPTION OF THE INVENTION

In this application "dischargeable hand weapon", "hand weapon", and "weapon" all mean a weapon or hunting device having a triggered discharge and designed to be partly or totally hand held while being discharged. Examples include handguns, rifles, shotguns, hand held rocket launchers such as the Gyro-Jet, crossbows, tear gas sprayers, and electric shocking devices. Criminal usefulness of a hand weapon includes the usefulness of the weapon for illegally threatening a person or injuring or killing a person or an animal.

Figure 1:
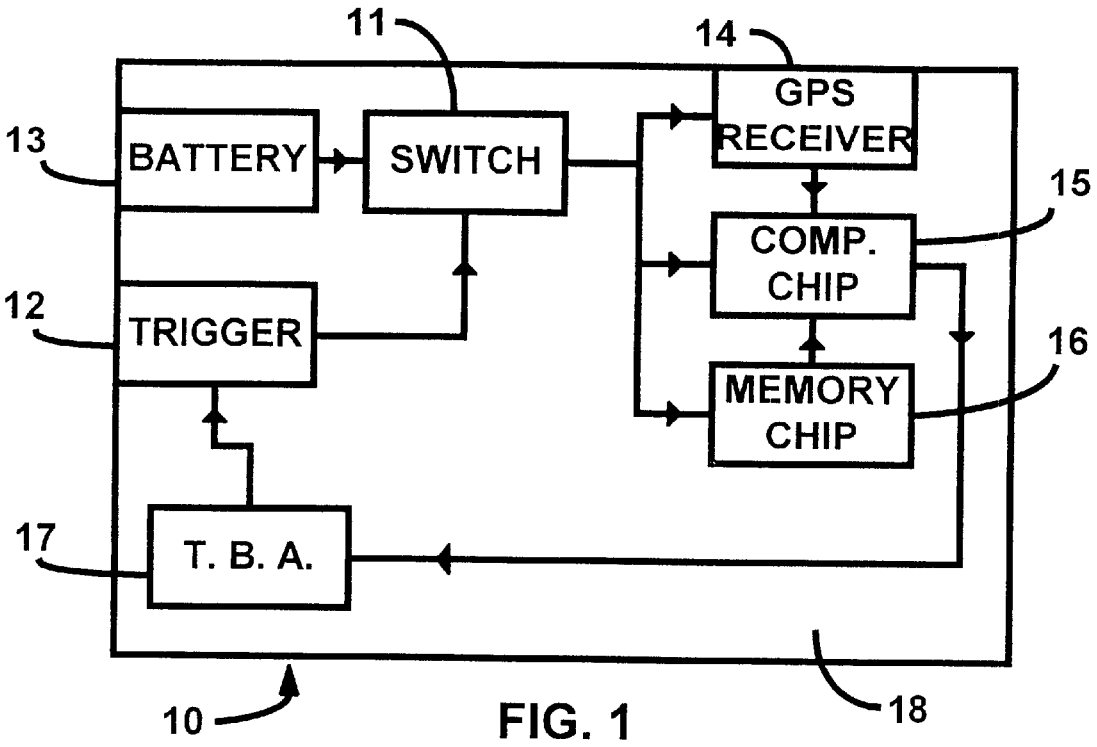
FIG. 1 is a block diagram of a revolver having electronic and electromechanical parts. The arrows indicate control is exerted by one part over another part in the direction of the arrow or there is an electric power or information flow from one part to another part in the direction of the arrow.
Figure 2:
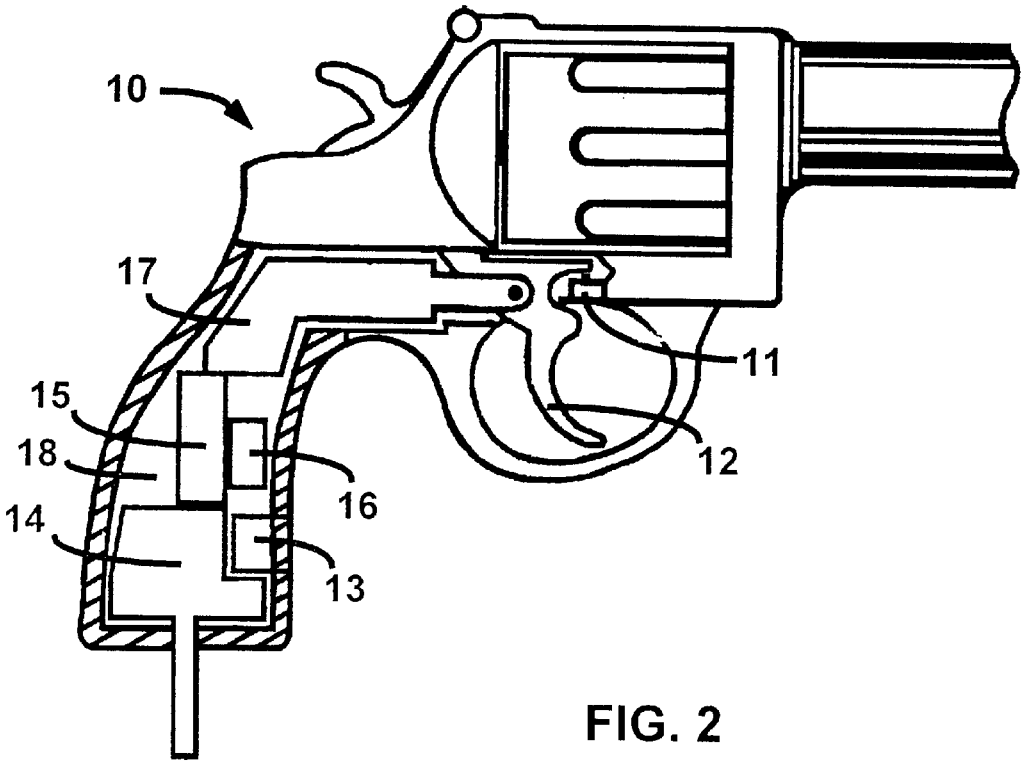
FIG. 2 is a side view of the same revolver with a portion of it broken away to illustrate internal parts.

FIGS. 1 and 2 illustrate a revolver 10 that can be fired only in certain locations. It is designed for defensive use in homes and businesses and for hunting. Except for its electronic and electromechanical parts, it is essentially a revolver of conventional design.

A normally open switch 11 is in mechanical contact with the trigger 12 and in electrical contact with a battery 13, a GPS receiver 14, a semiconductor comparator chip 15, and a semiconductor memory chip 16. The comparator chip 15 is also in electrical contact with the GPS receiver 14, the memory chip 16, and a trigger blocking apparatus 17 that is in mechanical contact with the trigger 12.

The battery 13 is located where it is accessible for replacement. It sends power to the switch 11. Slightly pulling the trigger 12 closes the switch 11, sending power to the GPS receiver 14, the comparator chip 15, and the memory chip 16.

The GPS receiver 14 operates essentially like other GPS receivers. When it is receiving power, it receives radio signals from four GPS satellites and functions as a means for determining the location of the revolver 10 based on the transmitting and arrival times of the signals, and thus their travel times. The location information provided as latitude and longitude data is then sent to the comparator chip 15.

The memory chip 16 serves as a means for storing information that defines at least one area of the earth's surface where firing of the revolver 10 is allowed (and therefore not allowed in all other areas). Previously, the memory chip 16 was programmed with information of the longitudes and latitudes of the boundary points of two areas where firing of the revolver 10 is allowed. Two areas are thus defined where firing of the revolver 10 is allowed. One of the areas is the property where the revolver 10 is kept for defense. The other area is where it can be used for hunting. When the memory chip 16 is receiving power, it sends its information to the comparator chip 15.

The comparator chip 15 operates like other semiconductor logic circuits and functions as a means for determining if the revolver's location is within an area where its firing is allowed. The comparator chip 15 receives information from both the GPS receiver 14 and the memory chip 16. When it is receiving power, the comparator chip 15 compares the two sets of information to determine if the revolver's location is within either one of the two areas where its firing is allowed. If the revolver's location is within either one of those two areas, the comparator chip 15 then sends power to the trigger blocking apparatus 17 to allowing firing.

The trigger blocking apparatus 17 functions as a means for preventing the firing of the revolver 10 based on the comparator chip 15 determining that the revolver 10 is not within an area where its firing is allowed. It should be noted that in this application the end result of preventing firing or discharging in areas where firing or discharging is not allowed is equivalent to allowing firing or discharging only in areas where firing or discharging is allowed.

The trigger 12 and trigger blocking apparatus 17 of this application are essentially the same as parts 60 through 70 of U.S. Pat. No. 4,488,370, and the switch is the same as part 17 of that same patent. The trigger blocking apparatus 17 prevents firing when it is not receiving power from the comparator chip 15 by blocking complete trigger movement, and it allows firing when it is receiving power by not blocking any trigger movement. Thus, after the trigger blocking apparatus 17 begins receiving power, firing can be accomplished by a continuation of trigger pull. Because the revolver's electronic processing is extremely fast, firing of the revolver 10 feels no different than firing a conventional revolver.

It is important that the revolver 10 has good resistance to tampering and circumvention. Such resistance is provided by potting 18 of the wiring, electronic parts, and as much of the electromechanical parts as possible. In addition, those parts and the part of the trigger 12 in contact with the trigger blocking apparatus 17 are enclosed in a part of the weapon that has been welded shut. Potting 18 and welding function as means for preventing parts from being accessed without causing damage that would prevent operation of and therefore firing of the revolver 10. Additional tamper and circumvention resistance is accomplished by the use of a trigger blocking apparatus 17 that prevents firing when it is not receiving power instead of one that prevents firing when it is receiving power (which could be easily circumvented by removing the battery 13).

Many variations of this invention are possible. One variation is the method of using a single radio transmitter to transmit the radio signals instead of at least three transmitters. The transmitter would be at the location of or in physical contact with the weapon, and the receivers would be in at least three different known locations. This method requires that the information of the signals' reception times, or the determined location, or the permissibility of discharging be transmitted to the circuitry on the weapon to allow discharging. Thus, there would be radio contact but not electrical contact for that transfer of information.

Another variation is the use of a rifle, shotgun, or other dischargeable weapon instead of a revolver. Still another variation is the use of three or four terrestrially located transmitters instead of four satellite transmitters. Another variation is the use of a lockable and unlockable access part and no potting so that the memory chip 16 can be accessed for reprogramming to change the areas where firing is allowed. It is also within the scope of this invention to make the GPS receiver 14, comparator chip 15, and memory chip 16 external to the revolver 10 and constantly powered. In such a variation, the output of the comparator chip 15 would be transmitted by a relatively weak radio transmitter to a receiver located on the revolver 10 and in contact with the trigger blocking apparatus 17. Thus, there would be radio contact but not electrical contact for that transfer of the comparator chip's information. The transmitter's power could be such that it would be unable to be received by the receiver when the receiver is more than 100 feet from the transmitter. Such an embodiment would be practical if space and/or weight requirements would not allow the GPS receiver 14, and chips 15 and 16 to be mounted on the revolver 10.

While the above description contains many specificities, they should not be construed as limitations on the scope of the invention, but rather as exemplifications of the preferred embodiments thereof. Many variations are possible without departing from the scope of the invention as defined in the appended claims and their legal equivalents.

What is claimed is:

1. A method for reducing the criminal usefulness of a dischargeable hand weapon comprising:

storing information that defines an area where the discharging of said weapon is allowed;

preventing the discharging of said weapon;

transmitting radio signals between the location of said weapon and at least three different known locations;

receiving said signals;

reckoning information of said location of said weapon based on the travel times of said signals;

deducing, by comparing said informations, if said location of said weapon is within said area;

allowing the discharging of said weapon if said deducing has deduced that said location of said weapon is within said area; and preventing the discharging of said weapon if said weapon is moved out of said area.

2. A method as claimed in claim 1 wherein said transmitting originates from said different known locations.

3. A method as claimed in claim 1 wherein said transmitting originates from at least three GPS satellites.

4. A method as claimed in claim 1 further comprising before said preventing step the steps of:

providing means for preventing and allowing the discharging of said weapon;

providing means for enclosing said preventing and allowing means; and enclosing said preventing and allowing means in an assembly comprising said weapon, said preventing and allowing means, and said enclosing means in a way such that said preventing and allowing means cannot be accessed without causing damage to a part of said assembly.

5. A method as claimed in claim 4 wherein said damage prevents said preventing and allowing means from allowing the discharging of said weapon.

6. An apparatus comprising:

a dischargeable hand weapon;

means for receiving radio signals transmitted between the location of said weapon and at least three different known locations;

reckoning means, in contact with said receiving means, for reckoning information of the location of said weapon based on the travel times of said signals;

means for storing information that defines an area of the earth's surface where the discharging of said weapon is allowed;

means, in contact with said reckoning means and said storing means, for deducing if said location of said weapon is within said area;

first preventing means, in contact with said weapon, for preventing, when functioning, the discharging of said weapon; and second preventing means, in contact with said first preventing means and said deducing means, for preventing the functioning of said first preventing means based on said deducing means deducing that said location of said weapon is within said area.

7. An apparatus as claimed in claim 6 wherein said receiving means, said reckoning means, said deducing means, and said storing means are carried on said weapon.

8. An apparatus as claimed in claim 6 wherein said receiving means and said reckoning means are parts of a GPS receiver.

9. An apparatus as claimed in claim 6 further comprising means, in contact with said weapon, for enclosing said first and second preventing means in an assembly comprising said weapon, said first and second preventing means, and said enclosing means, such that neither of said first and second preventing means can be accessed without causing damage to a part of said assembly.

10. An apparatus as claimed in claim 9 wherein said damage prevents said second preventing means from functioning.

* * * * *